United States Patent [19]

Fuchs, Jr. et al.

[11] 4,021,156

[45] May 3, 1977

[54] HIGH PRESSURE HYDRAULIC SYSTEM

[75] Inventors: Francis Joseph Fuchs, Jr., Princeton Junction; John Richard Shaffer, Ewing Township, Mercer County, both of N.J.

[73] Assignee: Western Electric Co., New York, N.Y.

[22] Filed: Jan. 15, 1976

[21] Appl. No.: 649,442

[52] U.S. Cl. ..... 417/346

[51] Int. Cl.[2] ..... F04B 17/00

[58] Field of Search ..... 417/225, 226, 344, 345, 417/346

[56] References Cited

UNITED STATES PATENTS

| | | | |
|---|---|---|---|
| 2,442,916 | 6/1948 | Buchanan | 417/346 |
| 2,660,955 | 12/1953 | Kent et al. | 417/346 |
| 3,077,838 | 2/1963 | Maglott | 417/346 |
| 3,773,438 | 11/1973 | Hall et al. | 417/346 |
| 3,893,790 | 7/1975 | Mayer | 417/346 |

*Primary Examiner*—John J. Vrablik
*Assistant Examiner*—G. P. LaPointe
*Attorney, Agent, or Firm*—A. S. Rosen

[57] ABSTRACT

Two hydraulic pressure intensifiers are coupled in parallel between a source of hydraulic fluid at relatively low pressure and an output path. Each intensifier provides a pressurizing stroke in only one direction of linear reciprocation. The intensifiers are so operated, under the control of a hydraulic circuit, as to create a tendency for an initial portion of the pressurizing stroke of each of the intensifiers to overlap a final portion of a preceding pressurizing stroke of the other intensifier, and thereby to deliver high pressure hydraulic fluid to the output path simultaneously with continuing delivery from such other intensifier. Such simultaneous delivery does not actually occur, however, since the hydraulic circuit is so arranged that the delivery of high pressure hydraulic fluid from each intensifier to the output line can begin only upon a falling off in the pressure provided by the other intensifier. Meanwhile, as soon as the pressure in the hydraulic fluid flowing from such other intensifier to the output line begins to fall off, such flow at decreasing pressure is interrupted. A surge-free flow of hydraulic fluid at a relatively high pressure is, thus, continuously present in the output line.

4 Claims, 8 Drawing Figures

HIGH PRESSURE HYDRAULIC SYSTEM

BACKGROUND OF THE INVENTION

1. Field of the Invention

This invention relates to high pressure hydraulic systems and, more particularly, to methods and apparatus for providing a flow of high pressure hydraulic fluid to a utilization device.

2. Description of the Prior Art

In the art of providing hydraulic fluid at high pressure, for use in hydrostatic forming systems or other utilization devices, it is known to utilize a single-acting pressure intensifier to increase the pressure of the fluid to a relatively high level. Typically, such a single-acting pressure intensifier includes a compound piston or ram, having a relatively large area on one face and a relatively small area on an opposite face, the compound piston being housed within a similarly configured, compound cylinder. A relatively low pressure applied to the larger face of the piston in the larger section of the compound cylinder causes a relatively high pressure to be produced in the hydraulic fluid at the smaller face of the piston in the smaller section of the compound cylinder during a pressurizing stroke of the compound piston. Such a pressure intensifier may be designated as single-acting in that it provides a pressurizing stroke in only one direction during linear reciprocation.

Single-acting pressure intensifiers of the type described are useful devices for delivering relatively short spurts of hydraulic fluid at high pressure, but are capable only of intermittently active operation. During an active phase of the operation of such a pressure intensifier, i.e., in the course of its pressurizing stroke, the required high pressure hydraulic fluid is delivered to the utilization device. However, between successive active phases of operation there must always be present inactive phases, corresponding to return strokes of the piston, such that a single pressure intensifier cannot deliver the high pressure hydraulic fluid to the utilization device continuously over extended periods of time.

In order to avoid the discontinuity of flow caused by the intermittent activity capability of individual single-acting hydraulic pressure intensifiers, resort has been made, in the prior art, to a technique of coupling two single-acting pressure intensifiers in parallel between a source of hydraulic fluid at relatively low pressure and a utilization device, and operating the intensifiers alternatingly. Such technique is exemplified by U.S. Pat. No. 527,981 to C. P. Higgins. In theory, at any one time, one of the intensifiers is in its active phase of operation, delivering hydraulic fluid at relatively high pressure to the utilization device, while the other intensifier is in its inactive phase. Conceptually, this technique would appear to have overcome the problem of discontinuous availability of high pressure fluid. However, it has been found, in practice, that the magnitude of the output pressure is not uniform throughout the pressurizing stroke of the conventional pressure intensifier. Instead, only a relatively low level of pressure intensification can be achieved when the piston is just commencing its pressurizing stroke and when it is approaching, and then attaining, the end of such stroke. As a result, periods of elatively low pressure, and variations in pressure and in flow, are characteristic of such systems for operating two, parallel-coupled, single-acting pressure intensifiers alternatingly.

Another technique which attempts to provide a continuous flow of high pressure hydraulic fluid is taught in U.S. Pat. No. 2,508,298 to O. J. Saari. This technique uses two double-acting pressure intensifiers, i.e., pressure intensifiers which are so structured as to provide pressurizing strokes in both directions of linear reciprocation. The two pressure intensifiers are coupled in parallel between a pressure source and an output path to a utilization device. Two control valves are used, each associated with a different one of the two double-acting pressure intensifiers, and each controlling the direction of movement of the compound piston of its respective intensifier. A reversal of the condition of the control valve for one of the compound pistons, causing a reversal in the direction of movement of such compound piston, is directly triggered upon the other compound piston, which constitutes, in effect, a control piston, attaining a triggering position in which it opens a conduit leading to such control valve. Such triggering position is so located as to commence the reversal operation for the first-mentioned compound piston as the control piston attains approximately the midpoint of its pressurizing stroke in one of the two directions of its linear reciprocation. In theory, this use of two double-acting pressure intensifiers with fluid control circuitry designed to operate the two pistons approximately 90° out-of-phase with one another, would serve to avoid all of the previously mentioned disadvantages and to deliver hydrauic fluid to the output path free of any discontinuities. It should be noted, however, that throughout a major portion of the operation of such a system, both pressure intensifiers are in an active condition, delivering a relatively large quantity of hydraulic fluid into the output path. During the reversal of each double-acting pressure intensifier, the flow of hydraulic fluid into the output line will quickly drop off, approaching one-half of that level which was present prior to such reversal and which will again be present prior to the reversal of the other intensifier. Thus, surges in the rate at which hydraulic fluid will flow into the output line to the utilization device will be experienced. These surges can introduce substantial departures from uniformity in the operation of such a system.

Accordingly, improved methods and apparatus for overcoming some of the discontinuities and surge effects of such prior art methods and apparatus would clearly be advantageous.

SUMMARY OF THE INVENTION

The invention contemplates providing two single-acting pressure intensifiers, each independently capable of pressurizing a hydraulic fluid to a desired, relatively high pressure when in an active phase of operation, with the two pressure intensifiers coupled in parallel between a source of the hydraulic fluid at a relatively low pressure and an output path which may lead to a utilization device, and so operating the two pressure intensifiers as to provide a continuous, relatively surge-free flow of high pressure hydraulic fluid. Such operation, briefly, entails so controlling the active phases of operation of the two single-acting pressure intensifiers as to create a tendency for an initial portion of the pressurizing stroke of each of the intensifiers to overlap a final portion of a preceding pressurizing stroke of the other intensifier, while preventing surges in the flow of hydraulic fluid into the output path by permitting the flow of hydraulic fluid from each intensifier into the output path to begin only upon a falling off in the pressure provided by the other intensifier, and simultaneously interrupting flow from such other intensifier into the output line. The desired control is achieved through the use of first and second control valve means, associated, respectively, with first and second pressure intensifiers, for each controlling the cycle of operation of its associated intensifier, the employment of third control valve means for controlling the sequence of operations of the other two control valve means, and the utilization of additional valve means for preventing simultaneous flow to the output path from both intensifiers. The third control valve means creates the described tendency for the pressurizing strokes to overlap by initiating reversal operations of the first control valve means only upon sensing that the second pressure intensifier has attained a condition wherein it is ready to deliver hydraulic fluid at relatively high pressure to the output path, and initiating reversal operations of the second control valve means only upon sensing that the first pressure intensifier has attained a condition wherein it is ready to deliver hydraulic fluid at relatively high pressure to the output path.

DESCRIPTION OF THE DRAWINGS

FIGS. 1 through 8 of the drawing are schematic illustrations of successive stages in the operation of a hydraulic system, constructed and utilized in accordance with the principles of the invention, for providing a continuous flow of high pressure fluid which is substantially free of pressure surges or variations.

DETAILED DESCRIPTION

Figure 1:
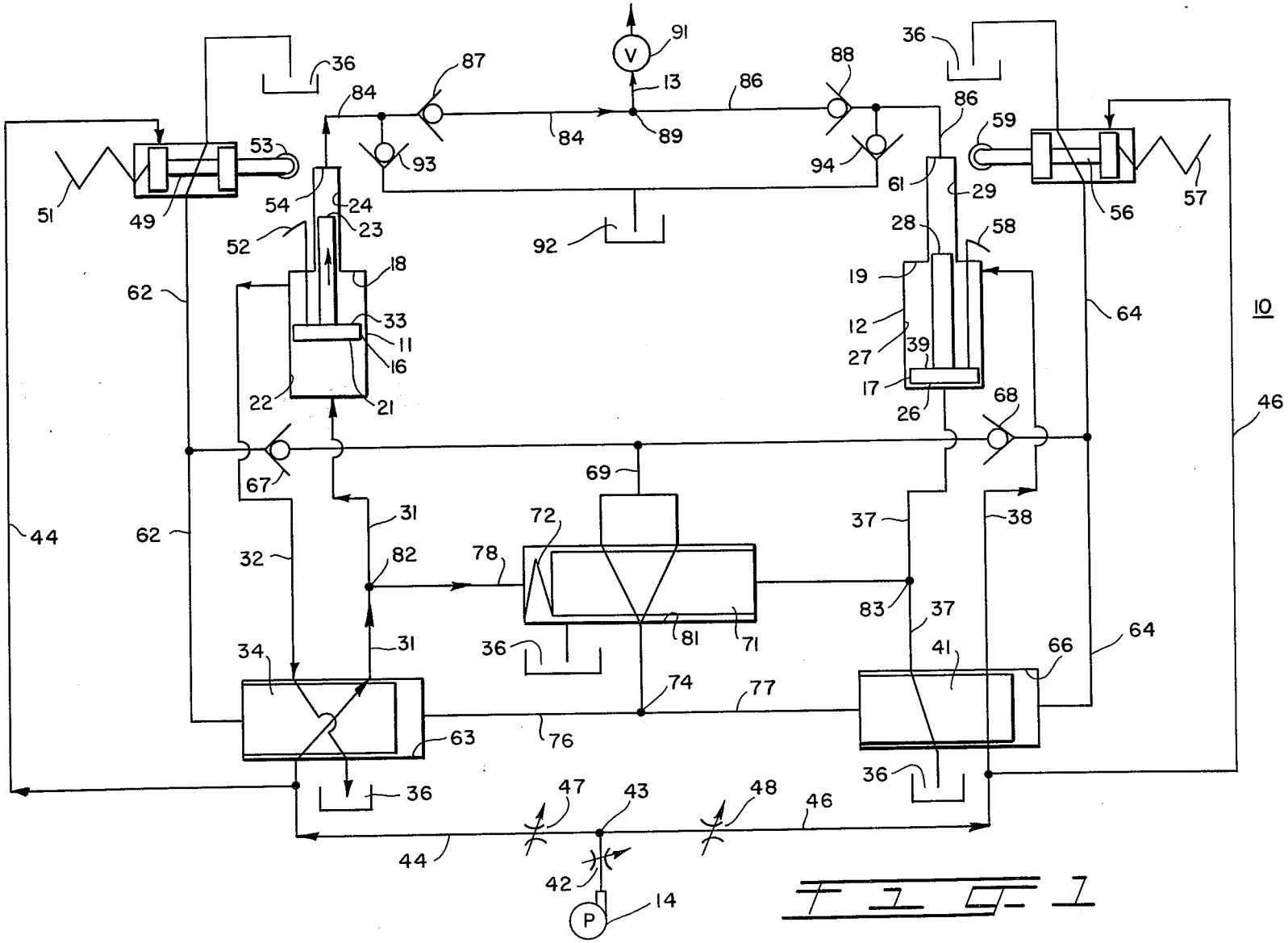

Referring first to FIG. 1 of the drawing, there is shown a hydraulic circuit 10 for so operating two conventional, single-acting hydraulic pressure intensifiers 11 and 12 as to provide a continuous, relatively surge-free flow of hydraulic fluid at a relatively high pressure, e.g., 50,000 p.s.i., through an output line or path 13 to a hydrostatic forming system or other utilization device (not shown). The circuit 10 includes a pump 14 coupled to a reservoir for hydraulic fluid (not shown). The pump is capable of delivering hydraulic fluid at a relatively low pressure, e.g., 2,000 p.s.i., to each of the pressure intensifiers 11 and 12. The intensifiers are coupled in parallel between the pump 14 and the output line 13, as will be described more fully hereinafter.

Each of the pressure intensifiers 11 and 12 includes a compound piston 16 or 17 which is housed within an associated compound cylinder 18 or 19. Compound piston 16 has a larger face 21 located in a larger section 22 of compound cylinder 18, and a smaller face 23 located in a smaller section 24 of compound cylinder 18. Compound piston 17 has a larger face 26 located in a larger section 27 of compound cylinder 19, and a smaller face 28 located in a smaller section 29 of compound cylinder 19. Suitable seals (not shown) isolate the smaller section 24 or 29 from the larger section 22 or 27 within each of the compound cylinders. Due to the differences in area across the larger and smaller faces of the compound pistons 16 and 17, the application of a relatively low pressure to the larger face 21 or 26 of each will cause the force transmitted through the compound piston to generate a relatively high pressure at the respective smaller face 23 or 28 of the compound piston. Such relatively high pressure will be no less than that desired in the output line 13. This relatively high pressure will be created during a pressurizing stroke of each compound piston 16 or 17, i.e., during a movement of the compound piston in an upward direction in the drawing with the pressure intensifier 11 or 12 which houses such compound piston in an active condition. No pressurization will, of course, be achieved during a downward, return stroke of each compound piston, i.e., during an inactive condition of the pressure intensifier 11 or 12.

A fluid line 31 opens into the larger section 22 of compound cylinder 18 at a location selected for continuous fluid communication with the larger face 21 of compound piston 16. Another fluid line 32 opens into the larger section 22 of compound cylinder 18 at a location selected for continuous fluid communication with an additional face 33 of compound piston 16, located between the faces 21 and 23, which additional face may have an area intermediate those of the faces 21 and 23. The operation of pressure intensifier 11 is to be controlled by the selective feeding of relatively low pressure fluid from the pump 14 alternatingly to the faces 21 and 33 of compound piston 16 under the control of a four-way, two-position, detent valve 34. The control valve 34 will alternatively couple fluid line 31 to the pump 14 and fluid line 32 to a sump 36, as in FIG. 1, or fluid line 32 to the pump and fluid line 31 to the sump, as in FIG. 3.

A fluid line 37 opens into the larger section 27 of compound cylinder 19 at a location selected for continuous fluid communication with the larger face 26 of compound piston 17. Another fluid line 38 opens into the larger section 27 of compound cylinder 19 at a location selected for continuous fluid communication with an additional face 39 of compound piston 17, located between the faces 26 and 28, which additional face may have an area intermediate those of the faces 26 and 28. The operation of pressure intensifier 12 is to be controlled by the selective feeding of relatively low pressure fluid from the pump 14 alternatingly to the faces 26 and 39 of compound piston 17 under the control of a four-way, two-position, detent valve 41. The control valve 41 will alternatively couple fluid line 37 to the pump 14 and fluid line 38 to the sump 36, as in FIG. 3, or fluid line 38 to the pump and fluid line 37 to the sump, as in FIG. 1.

During the operation of the hydraulic system, low pressure hydraulic fluid will be fed from the pump 14 through a flow control valve 42 and a junction 43 into fluid lines 44 and 46, which include additional flow control valves 47 and 48, respectively. Fluid line 44 leads both to control valve 34 and to a pilot valve 49 which is biased toward an inactive condition by a spring 51. A valve actuating mechanism 52 is so associated with compound piston 16 that a roller-carrying plunger 53 on the pilot valve 49 will urge such pilot valve into an active condition, against the bias of the spring 51, as compound piston 16 approaches the end of its pressurizing stroke (FIG. 2), i.e., as the active phase of operation of pressure intensifier 11 is coming to an end, with the smaller face 23 of the piston nearing a far end 54 of the smaller section 24 of compound cylinder 18.

Similarly, fluid line 46 leads both to control valve 41 and to a pilot valve 56 which is biased toward an inactive condition by a spring 57. A valve actuating mechanism 58 is so associated with compound piston 17 that a roller-carrying plunger 59 on the pilot valve 56 will urge such pilot valve into an active condition, against the bias of spring 57, as compound piston 17 approaches the end of its pressurizing stroke (FIG. 6), i.e., as the active phase of operation of pressure intensifier 12 is coming to an end, with the smaller face 28 of the piston nearing a far end 61 of the smaller section 29 of compound cylinder 19. Each of the two valve actuating mechanisms 52 and 58 is preferably of a type which includes a camming surface associated with the respective compound piston 16 or 17, and a latching device for triggering operation of the actuating mechanism only when the camming surface is in position to fully actuate the respective control valve 34 or 41 into an active condition.

Figure 3:
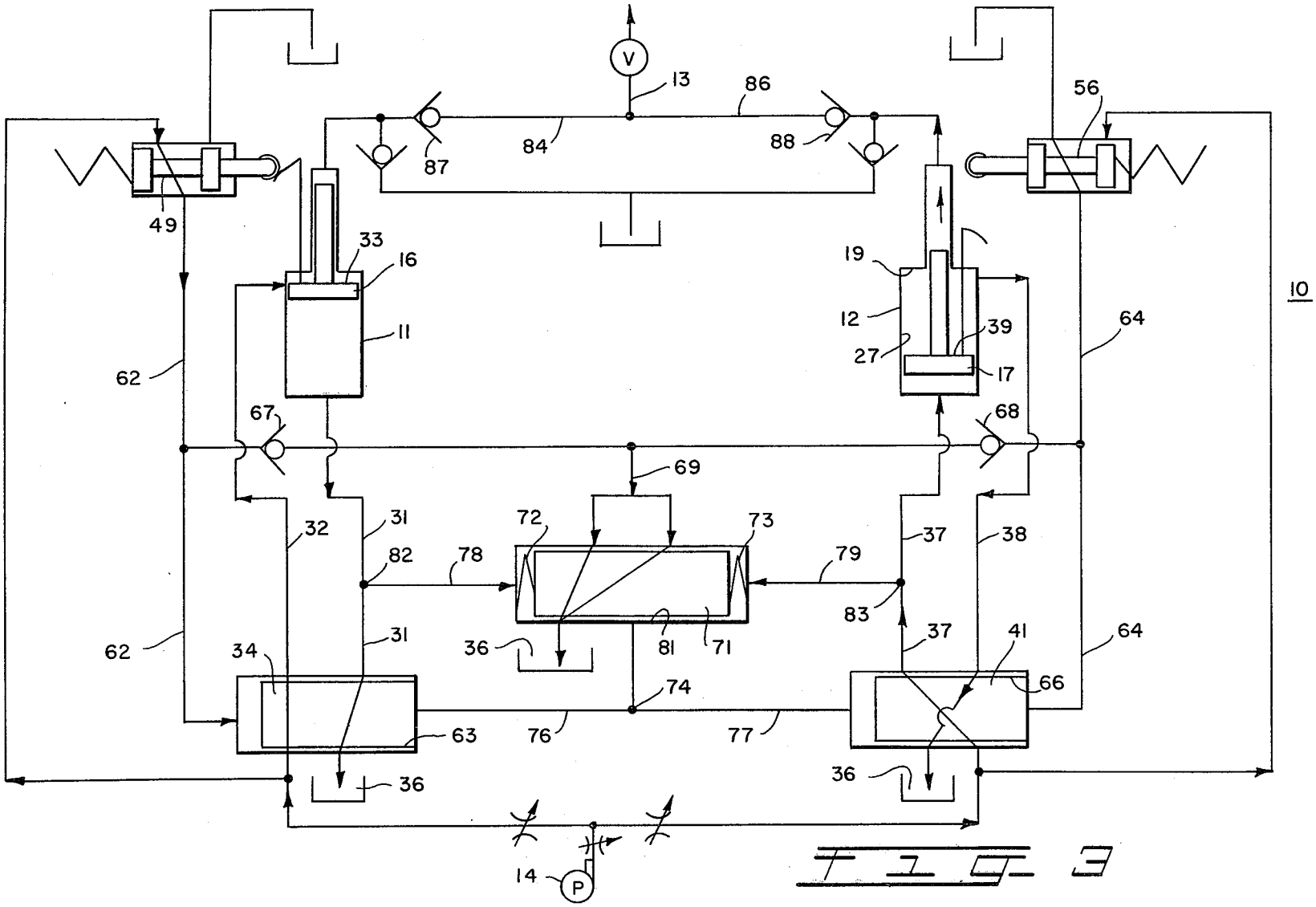
Figure 4:
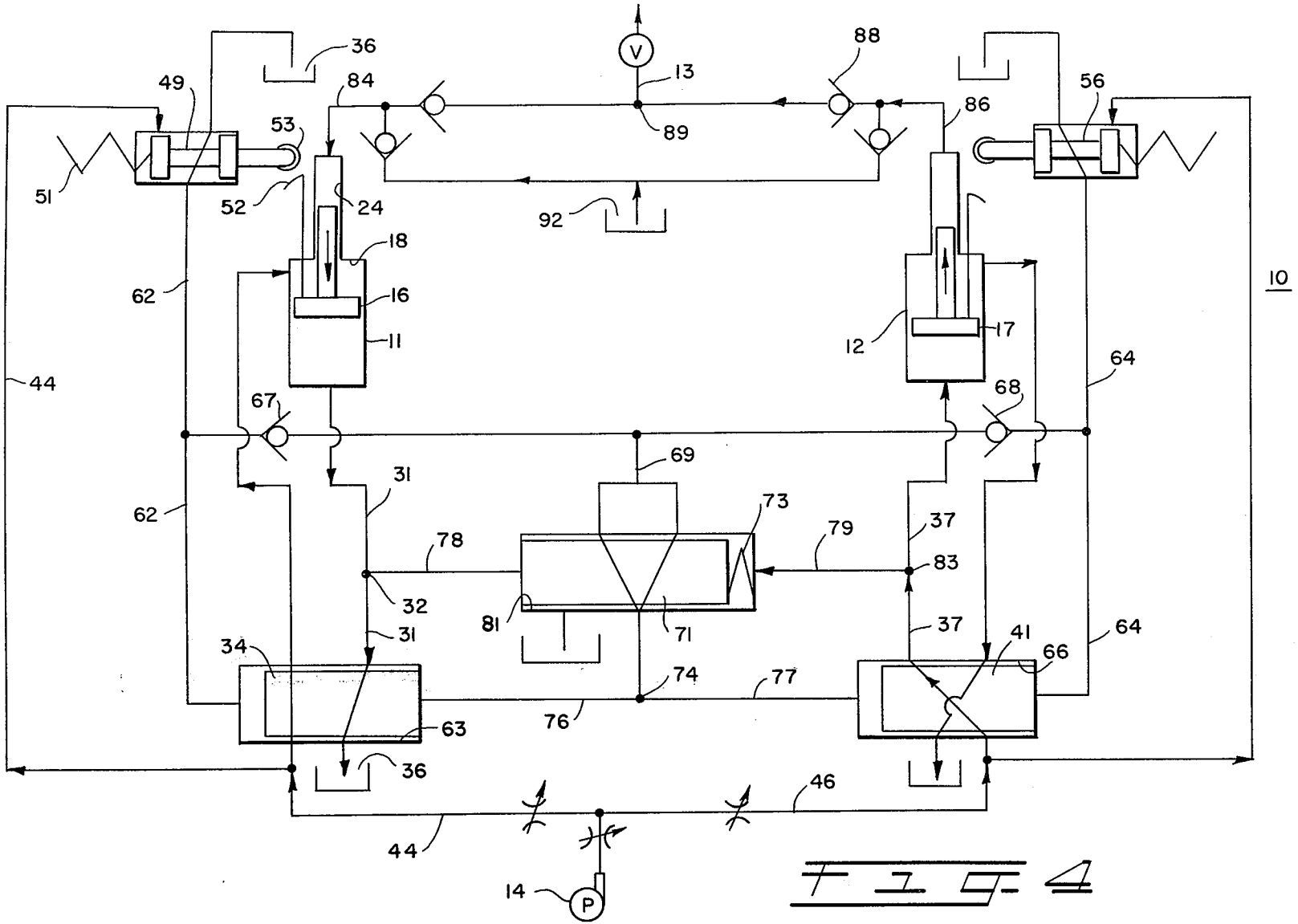

A fluid line 62 couples pilot valve 49 to one end of a chamber 63 which houses control valve 34, while another fluid line 64 couples pilot valve 56 to one end of a chamber 66 which houses control valve 41. As illustrated in the drawing such chamber ends are, respectively, the left end of chamber 63 and the right end of chamber 66. The fluid lines 62 and 64 also couple the pilot valves 49 and 56, through respective check valves 67 and 68, to a fluid line 69. Fluid line 69 leads to a three position crossover valve 71, which is biased toward a centered position by springs 72 (FIGS. 1 and 3) and 73 (FIGS. 3 and 4). In its active condition (FIG. 2), pilot valve 49 will provide fluid communication between fluid line 44 from the pump 14, and fluid line 62 to the control valve 34 and the crossover valve 71. In its active condition (FIG. 6), pilot valve 56 will provide fluid communication between fluid line 46 from the pump 14, the fluid line 64 to the control valve 41 and the crossover valve 71. Each of the pilot valves 49 and 56, in the inactive condition (FIG. 19 toward which it is biased by the associated spring 51 or 57, will provide fluid communication between its respective fluid line 62 or 64 and the sump 36.

Of the three possible positions for the crossover valve 71, two, corresponding to the alternate end positions of FIGS. 1 and 4, will couple fluid lines 62 and 64, through the respective check valves 67 and 68 and fluid line 69, to a junction 74 with fluid lines 76 and 77. Fluid line 76 leads to an end of the chamber 63 for control valve 34 remote from the end associated with fluid line 62, while fluid line 77 leads to an end of the chamber 66 for control valve 41 remote from the end associated with fluid line 64. As illustrated in the drawing, such chamber ends fed by fluid lines 76 and 77 are, respectively, the right end of chamber 63 and the left end of chamber 66. In a third, central position of the crossover valve 71 (FIG. 3), fluid lines 62 and 64 will both be coupled through the check valves 67 and 68 to the sump 36. The position of the crossover valve is at all times controlled by the combined effects of the springs 72 and 73 and of the presence or absence of fluid pressure in two fluid lines 78 and 79 which run to opposite ends of a chamber 81 housing the crossover valve. Fluid line 78 is fed from fluid line 31 through a junction 82, while fluid line 79 is fed from fluid line 37 through a junction 83.

The ends 54 and 61 of the respective smaller sections 24 and 29 of the compound cylinders 18 and 19 are both coupled to the output line 13 through respective fluid lines 84 and 86, which include check valves 87 and 88, and through a junction 89. The opposed check valves 87 and 88 will serve to prevent flow through junction 89 and into the output line 13 from either of fluid lines 84 and 86 when hydraulic fluid at the same or a greater pressure is flowing into the output line from the other of fluid lines 84 and 86. A valve 91 may be located along the output line 13, e.g., in the vicinity of the utilization device, and may be utilized to limit the output pressure from the system to a desired value within the individual capacity of each of the pressure intensifiers 11 and 12.

A makeup tank 92 is coupled through a check valve 93 to the fluid line 84 between the end 54 of compound cylinder 18 and check valve 87. The makeup tank is also coupled through a check valve 94 to the fluid line 86 between the end 61 of compound cylinder 19 and check valve 88. Makeup hydraulic fluid is contained in the tank 92, which may consititute or be fed from the sump 36, for use in replenishing hydraulic fluid in the smaller sections 24 and 29 of the compound cylinders 18 and 19 during the return strokes of the respective compound pistons 16 and 17.

The operation of the hydraulic system will next be discussed with reference to the successive figures of the drawing, which indicate the successive conditions of the hydraulic circuit 10 during a cycle of operation of the single-acting pressure intensifiers 11 and 12.

As illustrated in FIG. 1 of the drawing, the hydraulic circuit 10 will be observed initially in a condition in which pressure intensifier 11 is in an active phase of operation and pressure intensifier 12 is in an inactive phase of operation. Compound piston 16 is about midway through its pressurizing stroke, while compound piston 17 has completed its return stroke. Control valve 34 is presently in its leftward position. Hydraulic fluid at a relatively low pressure from the pump 14 is flowing through fluid line 44, and is being directed by control valve 34 into fluid line 31, such that the fluid applies pressure to larger face 21 and thereby drives compound piston 16. The hydraulic fluid displaced by face 33 of compound piston 16 is exiting from the larger section 22 of compound cylinder 18 through fluid line 32, and is passing through control valve 34 to the sump 36. A relatively high pressure, no less than that desired in the output line 13, is being generated in the hydraulic fluid ahead of smaller face 23 of the advancing compound piston. This fluid is being forced out through the end 54 of compound chamber 18, into fluid line 84, through check valve 87, through junction 89 and into the output line 13.

Meanwhile, control valve 41 is also in its leftward position. Low pressure hydraulic fluid from the pump 14 is present in fluid line 46, and is introduced by control valve 41 into fluid line 38, such that the fluid applies pressure to face 39 and maintains compound piston 17 in an end position which such compound piston has attained at the termination of its return stroke. The larger face 26 of compound piston 17 communicates with the sump 36 through line 37 and control valve 41. No hydraulic fluid is being forced out through the end 61 of compound cylinder 19. Compound cylinder 19 is kept isolated from high pressure fluid in fluid line 84 by check valve 88 in fluid line 86, such that the flow of high pressure fluid into the output line 13 from fluid line 84 can continue.

The pilot valves 49 and 56 are presently both maintained in their inactive conditions by the respective springs 51 and 57, such that fluid lines 62 and 64 are connected to the sump 36 and no fluid is flowing into fluid line 69 to the crossover valve 71. The crossover valve is presently maintained in its right end position, as illustrated in the drawing, by pressure from fluid line 31 through junction 82 and fluid line 78, the right end of crossover valve 71 not receiving pressure since fluid line 79 is connected to the sump 36 through junction 83, fluid line 37 and control valve 41.

Figure 2:
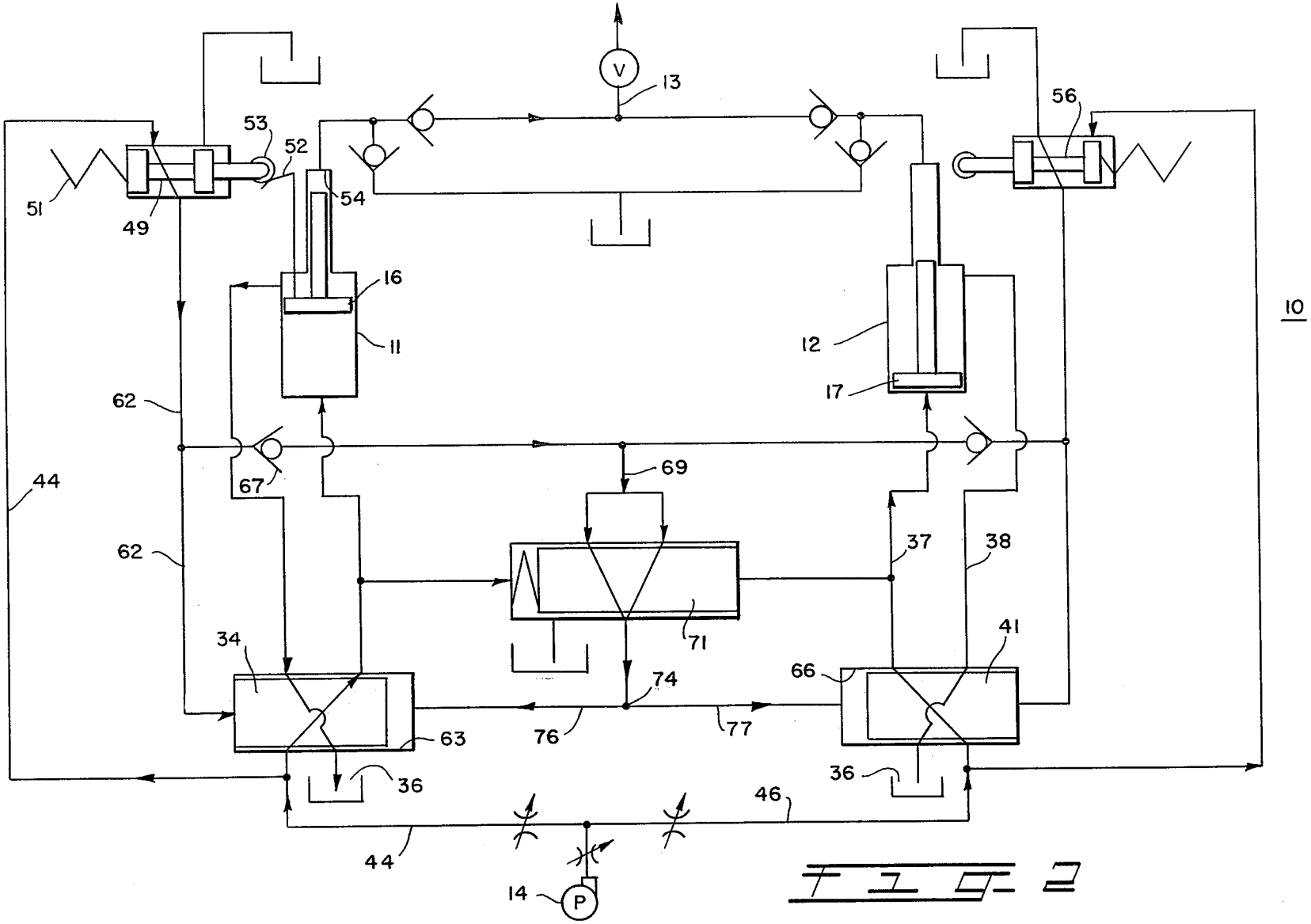

Turning now to FIG. 2 of the drawing, compound piston 16 continues to deliver hydraulic fluid at relatively high pressure to the output line 13. As compound piston 16 approaches the end of its pressurizing stroke, the valve actuating mechanism 52 associated with such compound piston actuates pilot valve 49 into its active condition by overcoming the force of spring 51. Fluid line 44 from the pump 14 is, thus, coupled to fluid line 62, and low pressure hydraulic fluid is fed into opposite ends of the chamber 63 housing pilot valve 34, both directly from fluid line 62 and indirectly, through check valve 67, fluid line 69, crossover valve 71, junction 74 and fluid line 76. The detent associated with control valve 34 maintains such valve in its lefward position, and the pressurizing stroke of compound piston 16 continues.

Meanwhile, the detent associated with control valve 41 is overcome, the control valve 41 is shifted into its rightward position, by application of low pressure fluid through fluid line 77 into the left end of chamber 66. Thus, line 37 becomes coupled to fluid line 46 from the pump 14, and fluid line 38 leads to the sump 36. The hydraulic pressure begins to build up in fluid line 37, as indicated diagrammatically in the drawing by half-arrows.

Referring next to FIG. 3 of the drawing, pressure in fluid line 37 becomes sufficient for compound piston 17 to begin its pressurizing stroke, with low pressure hydraulic fluid flowing into the larger section 27 of compound cylinder 19 through fluid line 37 and hydraulic fluid ahead of face 39 of compound piston 17 flowing out to the sump 36 through fluid line 38. However, check valve 88 remains closed as long as high-pressure hydraulic fluid, delivered during the final portion of the pressurizing stroke of compound piston 16, is present in fluid line 84, output line 13 and in the portion of fluid line 86 downstream of check valve 88. Thus, there is no surge in the flow of high pressure hydraulic fluid to the output line 13.

Meanwhile, the increased hydraulic pressure in fluid line 37 is also communicated through junction 83 and fluid line 79 to the right end of chamber 81, equalizing the pressure at the opposite ends of this chamber. The spring 73 acts to move the crossover valve 71 toward the right and into a centered position. Fluid line 62 is, thus, connected to the sump 36 through check valve 67, fluid line 69 and the crossover valve 71, so that the flow of pressurized fluid to the left end of chamber 63 and the right end of chamber 66, through junction 74 and the respective fluid lines 76 and 77, is interrupted. The detent associated with control valve 41 maintains such valve in its rightward position, while the detent associated with control valve 34 is overcome by pressure in fluid line 62, such that control valve 34 is shifted into its rightward position. As a result, low pressure hydraulic fluid from the pump 14 is fed into fluid line 32, and fluid line 31 is connected to the sump 36. Thus, compound piston 16 as slowed, stopped, and then reversed by virtue of the increasing hydraulic pressure on face 33. The active phase of operation of pressure intensifier 11 terminates. Meanwhile, pressure intensifier 12 takes over, with compound piston 17 providing the required flow of relatively high pressure into output line 13, as check valve 88 opens and check valve 87 closes.

With reference now to FIG. 4 of the drawing, compound piston 17 continues along its pressurizing stroke, feeding hydraulic fluid at relatively high pressure into the output line 13 through fluid line 86, check valve 88 and junction 89. Compound piston 16 is on its return stroke, with makeup hydraulic fluid entering into the smaller section 24 of compound cylinder 18 from the makeup tank 92 through check valve 93 and fluid line 84. Valve actuating mechanism 52 has now been disengaged from the roller of plunger 53, the spring 51 causing pilot valve 49 to return to its inactive condition. Thus, hydraulic fluid no longer flows from fluid line 44 into fluid line 62, fluid line 62 instead being connected to the sump 36. Control valve 34 is maintained in its rightward position by its detent.

The right end of chamber 81 is presently receiving hydraulic fluid under low pressure from the pump 14 through fluid lines 46, 37 and 79, while the left end of chamber 81 is connected to the sump 36 through fluid lines 78 and 31. The crossover valve 71 has moved, therefore, into its left end position.

Figure 5:
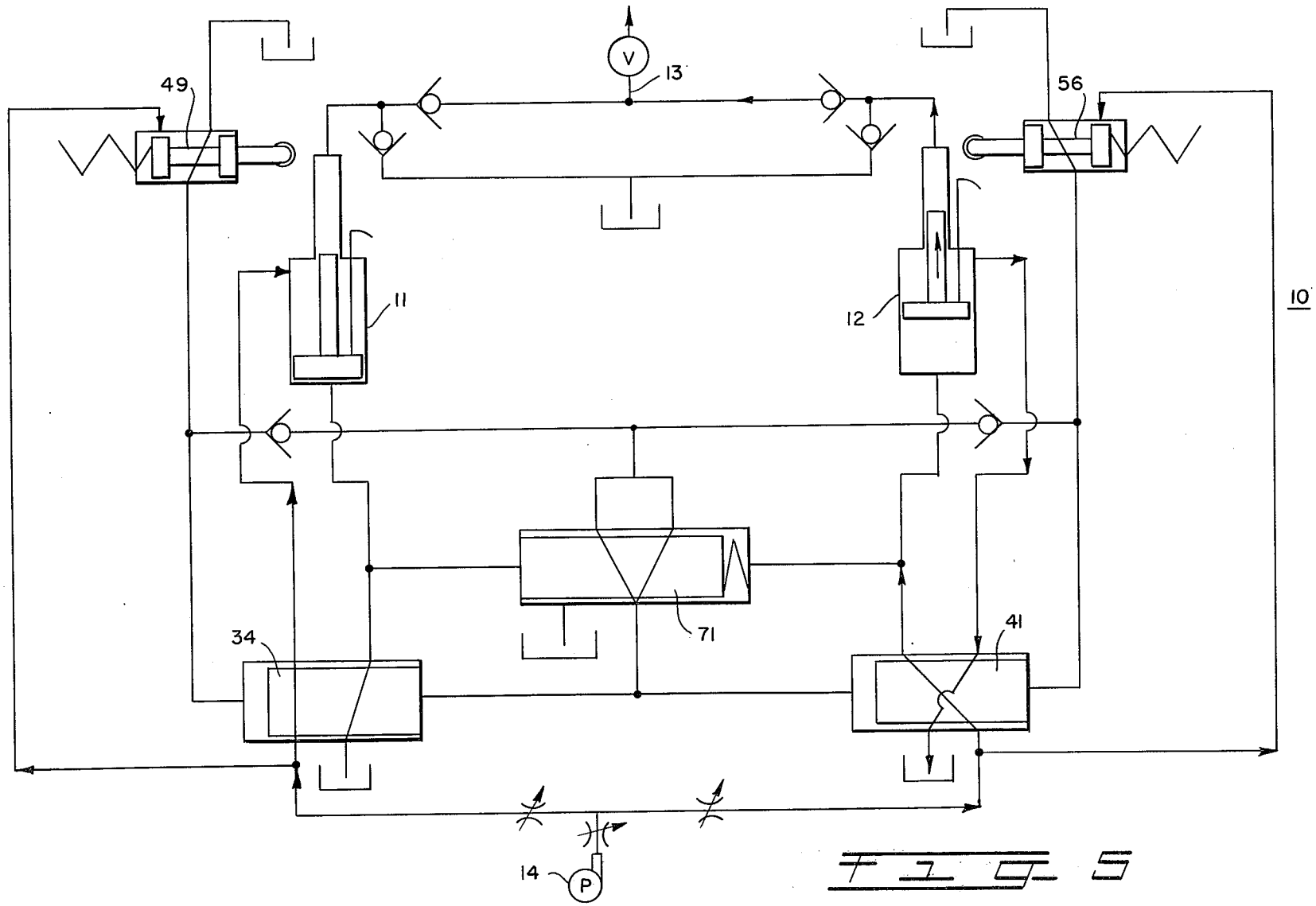
Figure 5:
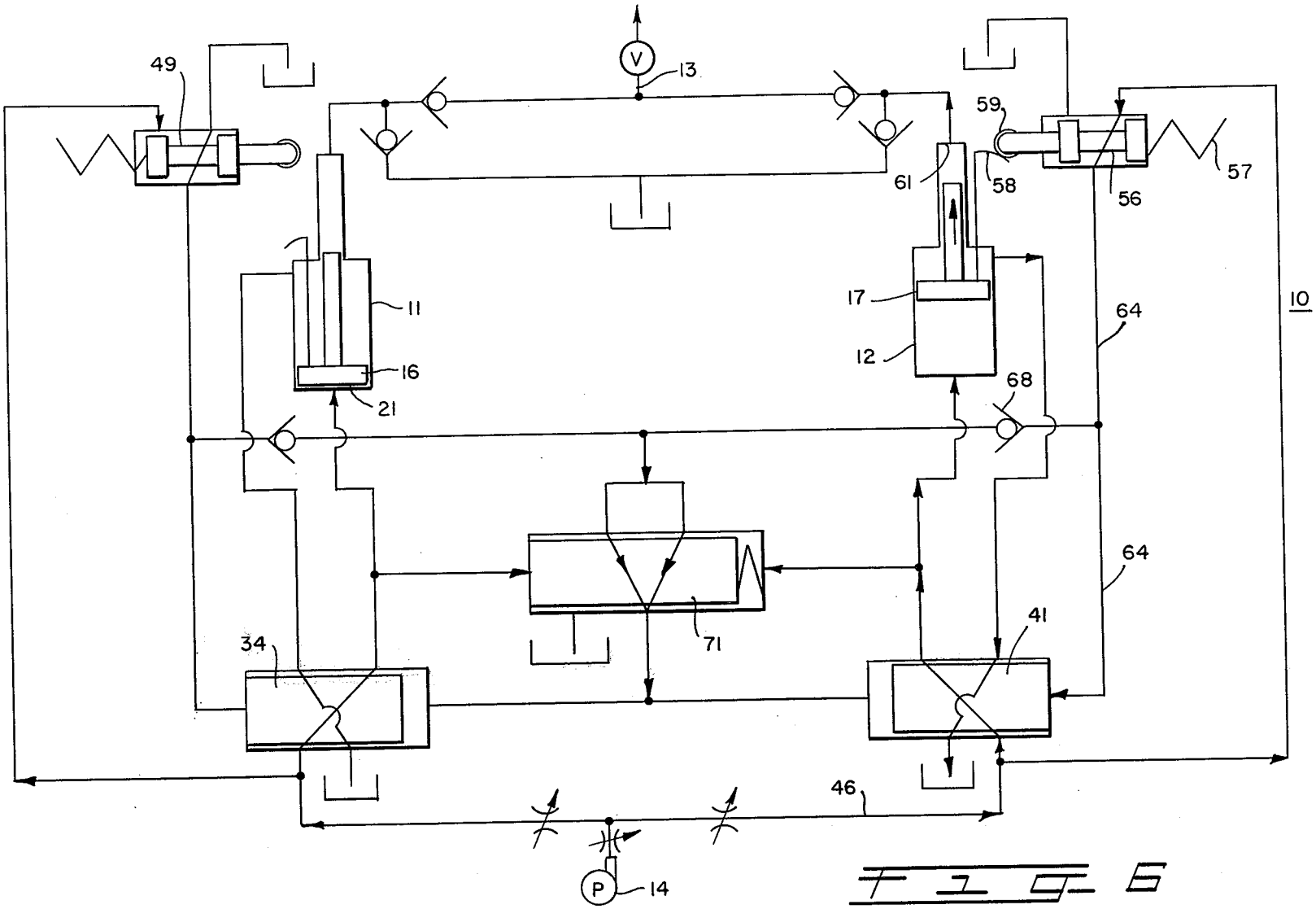

Turning next to FIG. 5 of the drawing, the hydraulic circuit 10 is presently in a condition similar to that of FIG. 1, except that it is now pressure intensifier 12, rather than pressure intensifier 11, which is in its active condition, with the control valves 34 and 41 and the crossover valve 71 now disposed in opposite positions from those shown in FIG. 1. The required high pressure hydraulic fluid continues to flow into output line 13 from pressure intensifier 12.

Figure 7:
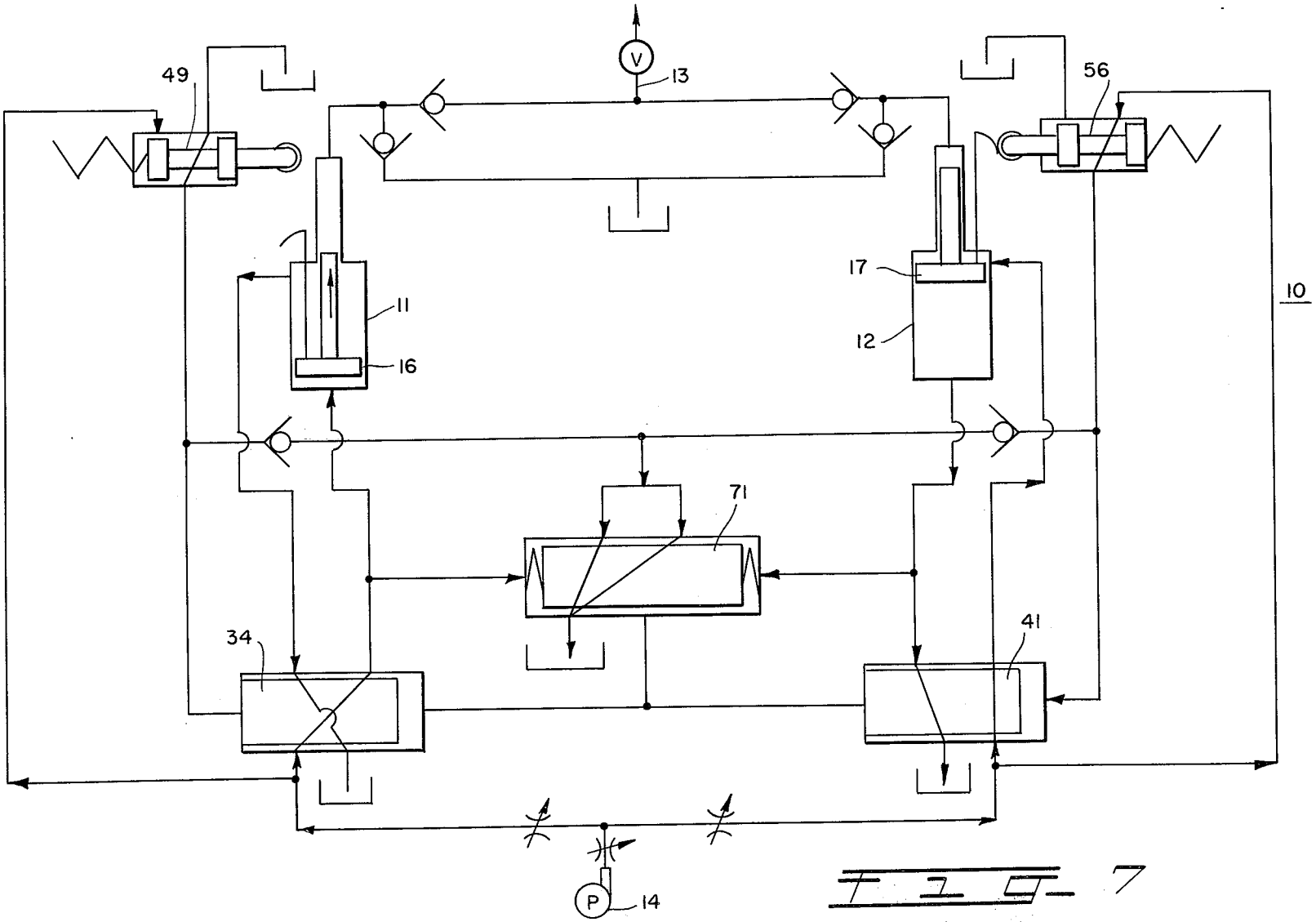
Figure 8:
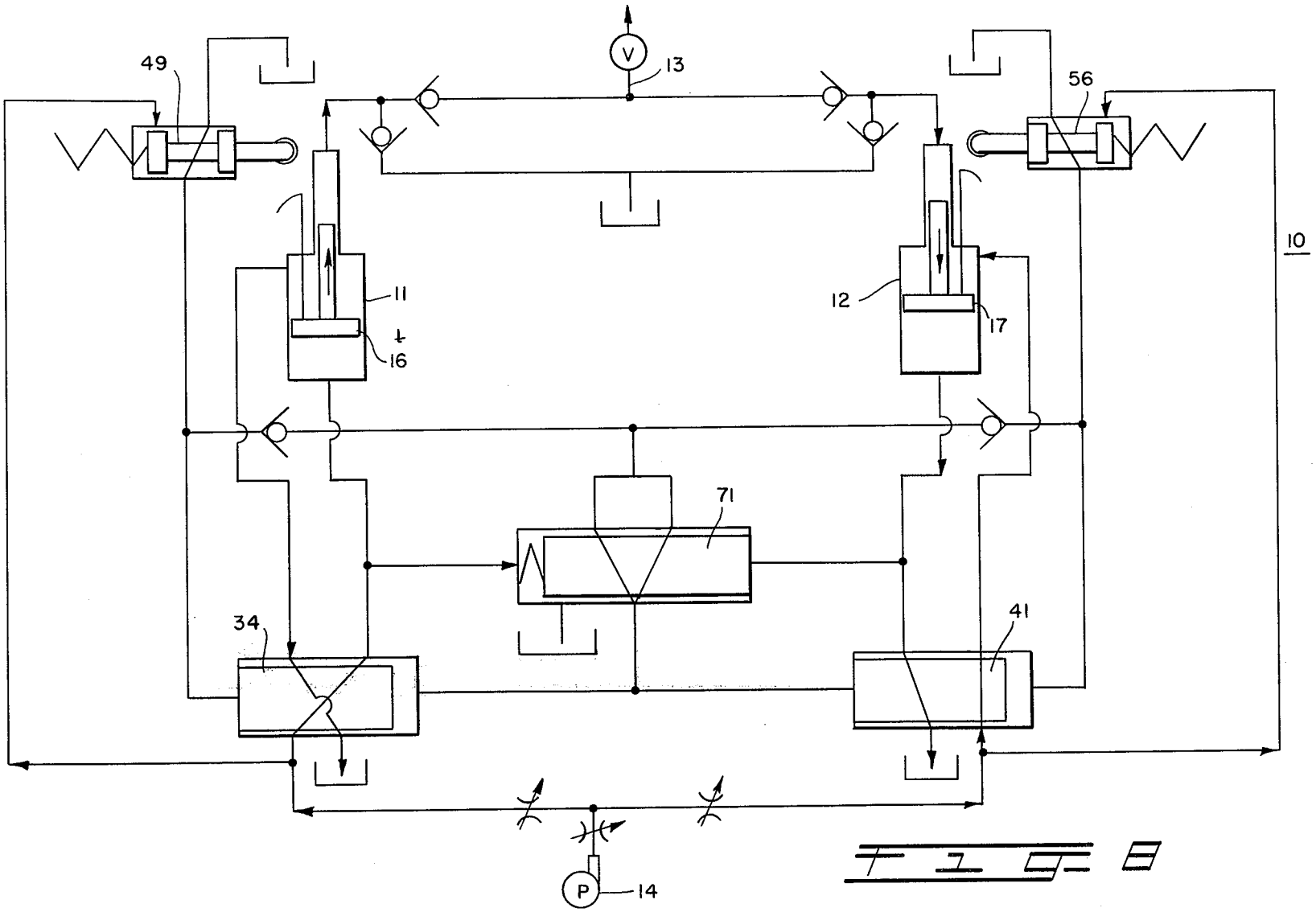

As seen in successive FIGS. 6–8 of the drawing, which correspond to FIGS. 2–4, respectively, with the active phases of the pressure intensifiers 11 and 12 reversed and the movements of the valves also reversed, the output line 13 continues to be fed with hydraulic fluid at relatively high pressure throughout the remainder of the cycle of the hydraulic circuit 10. In FIG. 6, the relatively high pressure is provided from pressure intensifier 12, as compound piston 17 nears the end of its pressurizing stroke and pressure begins to build up on larger face 21 of compound piston 16, with the crossover valve 71 soon to be shifted to its centered position once the pressure on face 21 has become sufficient for intensifier 11 to deliver hydraulic fluid at the required high pressure to the output line 13. In FIG. 7, the crossover valve 71 has shifted, and compound piston 16 has begun its pressurizing stroke, with the conditions of check valves 87 and 88 having reversed simultaneously as the pressurizing stroke of compound piston 17 ended, so as to insure the continuous, surge-free flow of hydraulic fluid at relatively high pressure into the output line 13. In FIG. 8, pressure intensifier 11 is delivering the high pressure hydraulic fluid to the output line, while compound piston 17 is on its return stroke. As the described cycle of operation of the hydraulic circuit 10 ends, the initial condition of FIG. 1 is again attained.

It is to be understood that the described hydraulic circuit is simply illustrative of a preferred embodiment of the invention. Many modifications may be made in accordance with the principles of the invention.

What is claimed is:

1. A method of providing a continuous flow of a hydraulic fluid at a relatively high pressure through an output path, which method comprises:

a. operating a first intermittently active pressure intensifier, capable of pressurizing the hydraulic fluid to a relatively high pressure when in an active phase of operation, with the first pressure intensifier coupled between a source of hydraulic fluid at relatively low pressure and the output path;

b. operating a second intermittently active pressure intensifier, also capable of pressurizing the hydraulic fluid to said relatively high pressure when in an active phase of operation, with the second pressure intensifier coupled in parallel with the first pressure intensifier between the source of hydraulic fluid and the output path;

c. sensing when the first pressure intensifier enters into condition to pressurize the hydraulic fluid to said relatively high pressure;

d. sensing when the second pressure intensifier enters into condition to pressurize the hydraulic fluid to said relatively high pressure;

e. initiating termination of the active phase of operation of the first pressure intensifier upon each sensing that the second pressure intensifier has entered into said pressurizing condition;

f. initiating termination of the active phase of operation of the second pressure intensifier upon each sensing that the first pressure intensifier has entered into said pressurizing condition;

g. initiating the entry of hydraulic fluid from the second pressure intensifier into the output path, at a flow rate matching that at which the hydraulic fluid has been flowing from the first pressure intensifier into the ouput path, upon each decrease, to below said relatively high pressure, in the pressure of the hydraulic fluid flowing from the first pressure intensifier into the output path; while simultaneously h. terminating the flow of hydraulic fluid from the first pressure intensifier into the output path; and i. initiating the entry of hydraulic fluid from the first pressure intensifier into the output path, at a flow rate matching that at which the hydraulic fluid has been flowing from the second pressure intensifier into the outlet path, upon each decrease, to below said relatively high pressure, in the pressure of the hydraulic fluid flowing from the second pressure intensifier into the output path; while simultaneously j. terminating the flow of hydraulic fluid from the second pressure intensifier into the output path.

2. Apparatus for providing a continuous flow of a hydraulic fluid at a relatively high pressure through an output path, which apparatus comprises:

first and second intermittently active pressure intensifiers, each independently capable of pressurizing the hydraulic fluid to a relatively high pressure when in an active phase of operation;

a source of hydraulic fluid at a relatively low pressure;

fluid path defining means, coupling said first and second pressure intensifiers in parallel between said source and the output path, for conducting hydraulic fluid from the source to each of the pressure intensifiers, and from each of the pressure intensifiers to the output path;

means for sensing when the first pressure intensifier enters into condition to pressurize the hydraulic fluid to said relatively high pressure;

means for sensing when the second pressure intensifier enters into condition to pressurize the hydraulic fluid to said relatively high pressure;

means, responsive to each sensing that the second pressure intensifier has entered into said pressurizing condition, for initiating termination of the active phase of operation of the first pressure intensifier;

means, responsive to each sensing that the first pressure intensifier has entered into said pressurizing condition, for initiating termination of the active phase of operation of the second pressure intensifier;

first entry initiating means, responsive to each decrease, to below said relatively high pressure, in the pressure of the hydraulic fluid flowing from the first pressure intensifier into the output path, for initiating entry of hydraulic fluid from the second pressure intensifier into the output path at a flow rate matching that at which the hydraulic fluid has been flowing from the first pressure intensifier into the output path;

means, rendered active simultaneously with operation of said first entry initiating means, for terminating the flow of hydraulic fluid from the first pressure intensifier into the output path;

second entry initiating means, responsive to each decrease, to below said relatively high pressure, in the pressure of the hydraulic fluid flowing from the second pressure intensifier into the output path, for initiating entry of hydraulic fluid from the first pressure intensifier into the output path at a flow rate matching that at which the hydraulic fluid has been flowing from the second pressure intensifier into the output path; and means, rendered active simultaneously with operation of said second entry initiating means, for terminating the flow of hydraulic fluid from the second pressure intensifier into the output path.

3. Apparatus for providing a continuous flow of a hydraulic fluid at a relatively high pressure through an output path, which apparatus comprises:

first and second intermittently active pressure intensifiers, each independently capable of pressurizing the hydraulic fluid to a relatively high pressure when in an active phase of operation;

a source of hydraulic fluid at a relatively low pressure;

fluid path defining means, coupling said first and second pressure intensifiers in parallel between said source and the output path, for conducting hydraulic fluid from the source to each of the pressure intensifiers, and from each of the pressure intensifiers to the output path;

first valve means, located in said fluid path defining means between said source and the first pressure intensifier, for controlling the cycling of the first pressure intensifier into and out of its active phase of operation;

second valve means, located in said fluid path defining means between said source and the second pressure intensifier, for controlling the cycling of the second pressure intensifier into and out of its active phase of operation;

a pair of opposed check valve means, one of said check valve means located in said fluid path defining means between the first pressure intensifier and the output path, and the other of said check valve means located in said fluid path defining means between the second pressure intensifier and the output path, for so controlling flow from the first and second pressure intensifiers that hydraulic fluid can enter into the output path from only one of the pressure intensifiers at a time; and third valve means, operated in response to equalization of the pressure in a first portion of said fluid path defining means extending between the first valve means and the first pressure intensifier, with the pressure in a second portion of said fluid path defining means extending between the second valve means and the second pressure intensifier, for so controlling operations of the first and second valve means as to terminate each active phase of operation of each pressure intensifier only upon the other pressure intensifier entering into condition to pressurize the hydraulic fluid to said relatively high pressure.

4. Apparatus as set forth in claim 3, further comprising:

fourth valve means, operated in response to the first pressure intensifier approaching the end of its active phase of operation, for providing hydraulic fluid at said relatively low pressure directly to one side of said first valve means and indirectly, through said third valve means, to both the other side of said first valve means and one side of said second valve means, an imbalance in pressures across said second valve means causing movement of said second valve means into position to supply hydraulic fluid at said relatively low pressure from said source to the second pressure intensifier so as to cause the second pressure intensifier to tend to enter into said condition to pressurize the hydraulic fluid to said relatively high pressure; and fifth valve means, operated in response to the second pressure intensifier approaching the end of its active phase of operation, for providing hydraulic fluid at said relatively low pressure directly to the other side of said second valve means and indirectly, through said third valve means, to both said one side of said second valve means and said other side of said first valve means, an imbalance in pressures across said first valve means causing movement of said first valve means into position to supply hydraulic fluid at said relatively low pressure from said source to the first pressure intensifier so as to cause the first pressure intensifier to tend to enter into said condition to pressurize the hydraulic fluid to said relatively high pressure.

* * * * *

UNITED STATES PATENT OFFICE

CERTIFICATE OF CORRECTION

Patent No. 4,021,156 Dated May 3, 1977

Inventor(s) Francis J. Fuchs, Jr. et al.

It is certified that error appears in the above-identified patent and that said Letters Patent are hereby corrected as shown below:

In the specification, column 1, line 65, "elatively" should read --relatively--. Column 5, line 30, "the fluid" should read --and fluid--; line 32, "19" should read --1)--. Column 7, line 16, "lefward" should read --leftward--; line 61, "as" should read --is--.

Signed and Sealed this nineteenth Day of July 1977

[SEAL]

Attest:

RUTH C. MASON
*Attesting Officer*

C. MARSHALL DANN
*Commissioner of Patents and Trademarks*